United States Patent [19]

Garcia

[11] Patent Number: 4,892,194

[45] Date of Patent: Jan. 9, 1990

[54] DISPLAY PACKAGE FOR A COSMETIC ARTICLE

[75] Inventor: Frank Garcia, Brooklyn, N.Y.

[73] Assignee: Arthur Matney Company, Inc., Brooklyn, N.Y.

[21] Appl. No.: 310,365

[22] Filed: Feb. 13, 1989

[51] Int. Cl.[4] ..... B65D 73/00

[52] U.S. Cl. ..... 206/470; 206/461; 206/477; 206/480; 206/493

[58] Field of Search ..... 206/471, 476, 461, 467, 206/470, 462, 464, 478, 480, 493, 45.15, 45.14

[56] References Cited

U.S. PATENT DOCUMENTS

| | | | |
|---|---|---|---|
| 3,519,128 | 7/1970 | Swanberg | 206/471 |
| 4,210,246 | 7/1980 | Kuchenbecker | 206/467 |
| 4,469,226 | 9/1984 | Matney | 206/467 |
| 4,805,766 | 2/1989 | Garcia | 206/471 |

*Primary Examiner*—Stephen Marcus

*Assistant Examiner*—Jacob Ackun, Jr.

*Attorney, Agent, or Firm*—Hoffmann & Baron

[57] ABSTRACT

A display package for a cosmetic case having a base containing a cosmetic product and a cover pivotally joined to the base includes a support backing, a pre-formed blister mounted on the backing, and a tongue or strip extending from the blister for securing the case to the support backing. The blister has a main blister portion which is raised from the backing, and an edge flange joined to the main blister portion and secured to the backing. The main blister portion has an open side and defines a pocket for receiving the base of the cosmetic case. The tongue extends through a clearance between the cover and base and has an end portion secured to the backing. The tongue prevents removal of the cosmetic case from the pre-formed blister through its open side. A single strip of flexible, transparent material may be used to form the main blister portion, tongue, and a pair of opposing edge flanges.

19 Claims, 3 Drawing Sheets

Fig. 4
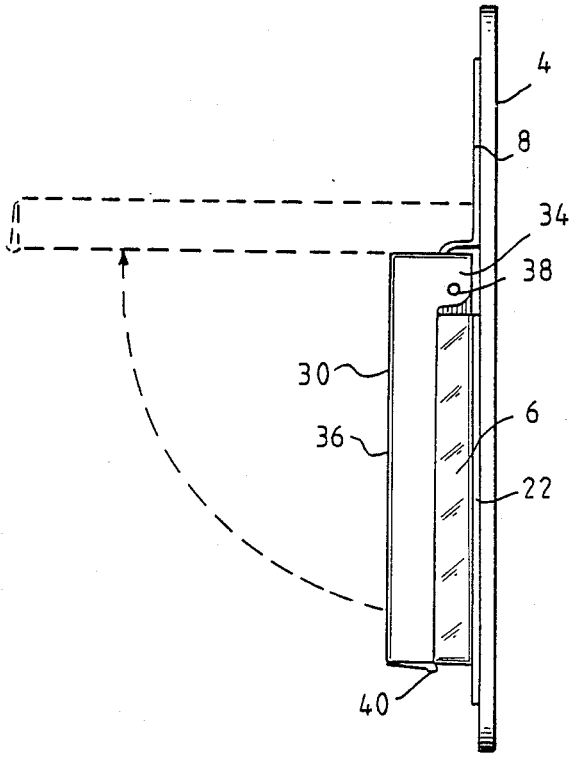
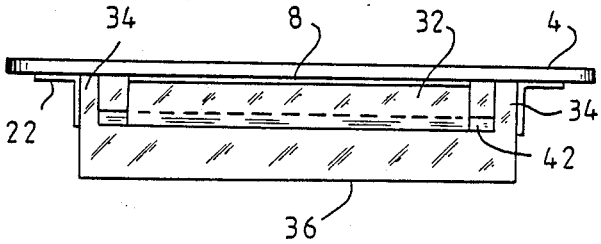
Fig. 5

DISPLAY PACKAGE FOR A COSMETIC ARTICLE

BACKGROUND OF THE INVENTION

1. Field of the Invention

This invention relates generally to display packages and more particularly to a display package for a cosmetic product, which package is tamper resistant yet allows the consumer to view the cosmetic contents of the article prior to purchasing the article.

2. Description of the Prior Art

Display packages for use with cosmetic articles which allow a purchaser to view the contents of the article without removing the article from the package are well known in the art. Such packages are often used with compact cases containing face powders, which cases may be opened and closed by the consumer, prior to purchasing the article, while the compact case remains secured to the package so that the consumer may check the shade of the face powder. Such display packages also resist tampering by the consumer.

For example, in U.S. Pat. No. 4,469,226 which issued to Arthur Matney, a display package is disclosed for use with a cosmetic compact case. The display package includes a transparent pre-formed blister which is heat-sealed to a support backing. The blister covers the base of the compact case, which base contains the face powder, and the cover of the case closes over the blister.

The structure mentioned above of the display package disclosed in the Matney '226 patent provides a number of apparent advantages. First, because only the base of the compact case is secured in the package, the cover is accessible to the consumer who may open the compact case without removing it from the package.

Second, the actual face powder contents of the compact case are viewable so that the consumer may check to see if the powder's shade is compatible.

Third, the face powder remains protected by the blister, even when the compact case is opened.

Fourth, the display package disclosed in the Matney '226 patent remains secured to the package even though the contents of the compact case are viewable to the consumer prior to purchasing the product. Thus, there is no need to remove the compact case from the package to view its contents so that the integrity of the display package remains intact.

The display package of the Matney '226 patent is particularly useful for compact cases having an overall circular or oval configuration. The blister conforms in shape to the round base of the compact case and covers a substantial portion of the base while an opening in the blister allows movement of the compact case hinge. In this way, the compact case may not be removed from the display package, but may easily be opened to see its contents.

SUMMARY OF THE INVENTION

It is an object of the present invention to provide a display package for a cosmetic article which allows a purchaser to examine the contents of the article without removing the article from the package.

It is another object of the present invention to provide a display package for a cosmetic article, and in particular, a cosmetic case having a base containing a cosmetic product and a cover pivotally mounted to the base so that the case may be opened and closed, which package allows the case to be opened and closed without damage to the display package.

It is a further object of the present invention to provide a tamper resistant display package for displaying an article as well as the contents of the article.

It is yet another object of the present invention to provide a display package for an openable cosmetic case which secures the case to the package but allows the case to be opened to view its contents.

It is yet another object of the present invention to provide a combination display package and cosmetic case in which the two cooperate so that the cosmetic case does not shift within the display package when in a closed position and will not slip out of the display package when the case is in an open position.

It is yet a further object of the present invention to provide a method for assembling a display package and mounting a cosmetic case in the display package.

The present invention is an alternative design to that disclosed in Matney U.S. Pat. No. 4,469,226. It is particularly adapted for displaying a cosmetic article having a rectangular case with a hinged cover and base, but the principles behind its design are equally applicable to openable cases of rounded shape. The display package allows the cosmetic case to be opened so that the contents of the case are viewable, while the case remains secured to the package.

In accordance with one form of the present invention, the display package includes a support backing having a display surface, a pre-formed blister mounted on the display surface of the support backing, and a tab or tongue extending from the blister.

The pre-formed blister has a main blister portion which is raised from the display surface, and further has an edge flange joined to the main blister portion. The edge flange is secured to the display surface by heat sealing or other methods. The main blister portion of the pre-formed blister includes an open side, and defines a pocket for receiving a cosmetic article in the pocket and for securing the article to the support backing.

The tongue extends from the main blister portion and over the open side thereof. When a compact case is positioned within the pocket, the tongue extends between the cover and base thereof. An end portion of the tongue is heat-sealed or otherwise secured to the display surface of the support backing.

Preferred forms of the display package, as well as other embodiments, objects, features and advantages of this invention, will be apparent from the following detailed description of illustrative embodiments thereof, which is to be read in connection with the accompanying drawings.

BRIEF DESCRIPTION OF THE DRAWINGS

FIG. 4 is a side elevation view of the display package and cosmetic case shown in FIG. 3, with the cover of the case in a closed position;

FIG. 5 is a top plan view of the display package and case shown in FIG. 4, with the cover of the case in a closed position.

DETAILED DESCRIPTION OF THE PREFERRED EMBODIMENTS

Figure 1:
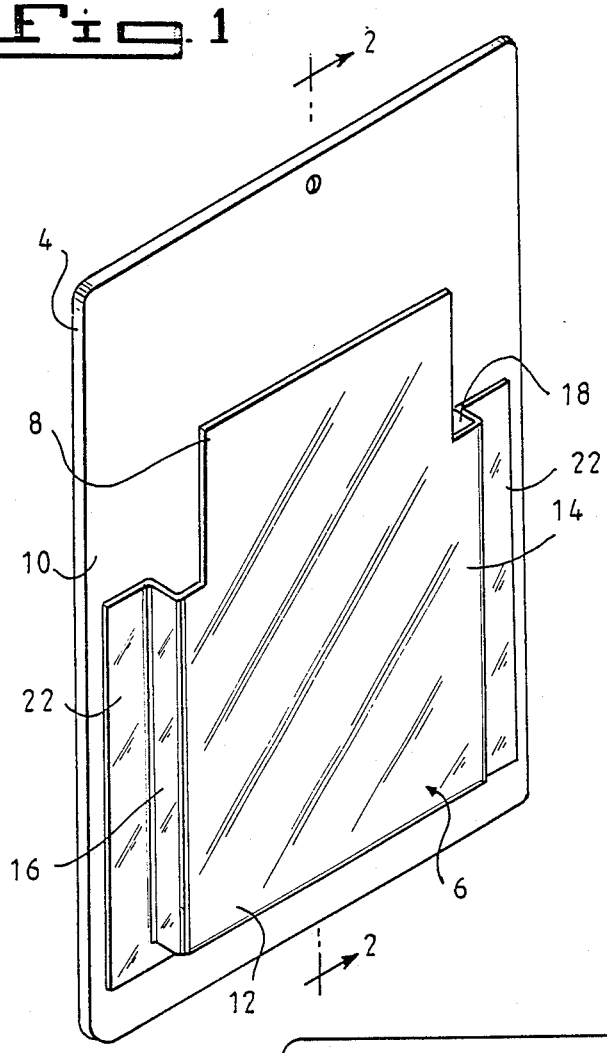
FIG. 1 is a perspective view of a display package constructed in accordance with the present invention.
Figure 2:
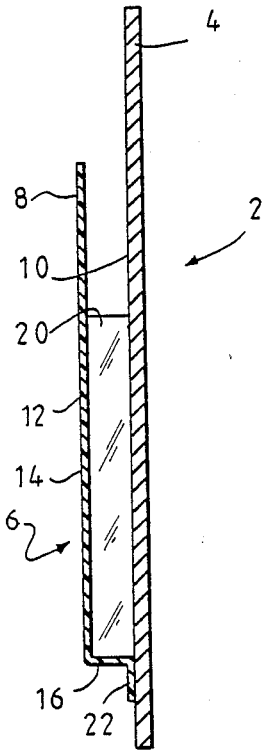
FIG. 2 is a sectional view of the display package of FIG. 1 taken along line 2—2 of FIG. 1.

FIGS. 1 and 2 of the drawings show a display package 2 constructed in accordance with the present invention. As is evident from FIGS. 1 and 2, the display package 2 shown is particularly adapted for use with a cosmetic article having an overall rectangular or square shape. However, the principles underlying the invention's construction are equally applicable for use with a cosmetic article of oval or round design.

There are two basic elements of the display package of the present invention—a support backing 4 and a pre-formed blister 6. A tongue 8 formed integrally with the blister extends over the support backing. The tongue may alternatively be formed as a separate element.

The support backing 4 is preferably a relatively rigid sheet of cardboard or similar cellulosic stock material. The backing 4 may be sufficiently thick so that it is substantially stiff to resist bending. Cardboard of about 10–20 mil. thickness is quite suitable for use. The support backing 4 is dimensioned so that it fully supports the cosmetic article to be attached to the display package and, as will be seen, is large enough so that the pre-formed blister 6 may be securely mounted on it.

The pre-formed blister 6 is mounted on one surface (referred to hereinafter as the display surface 10) of the support backing 4. This blister 6 includes a main blister portion 12 having a rectangular top wall 14 and three side walls 16 that are perpendicular to the display surface 10 of the support backing and joined to three sides of the top wall 14. The main blister portion 12 has a fourth side 18 which is open. Thus, the main blister portion 12 is raised from the display surface 10 of the backing a distance sufficient to accommodate the cosmetic article, or a part of the article, and defines a pocket 20 for receiving the cosmetic article and securing it to the display package 2.

The pre-formed blister 6 also includes an edge flange 22 which is joined to the main blister portion 12. More specifically, the edge flange 22 is connected to the three side walls 16 of the main blister portion and thus surrounds the main blister portion on three of its sides.

The edge flange 22 is provided for securing the blister to the display surface 10 of the support backing. Conventional techniques may be used for securing the edge flange to the backing, such as heat sealing, or using an adhesive.

Figure 3:
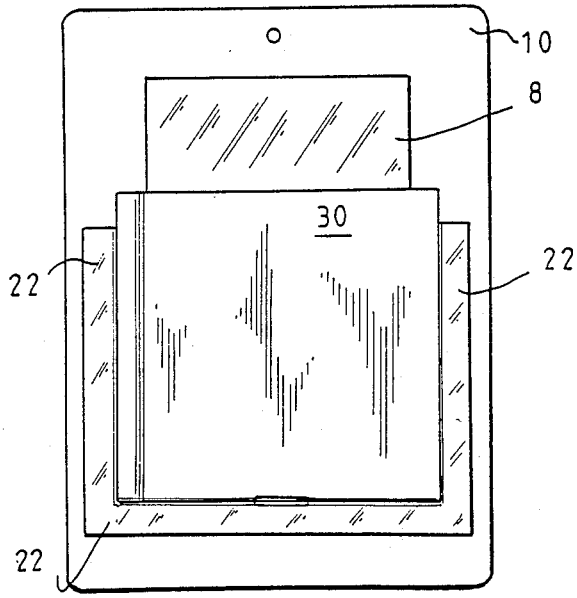
FIG. 3 is a front view of the display package of FIG. 1, with a cosmetic case secured in the package and with its cover closed.

FIGS. 3 through 5 illustrate how the present invention acts to keep a cosmetic article secured to the package while allowing a purchaser to examine the contents of the article, without the purchaser having to remove the article from the package.

The display package 2 of the present invention is designed primarily for use with a cosmetic article in the form of a case 30, having a base 32 containing the cosmetic product and a cover 36 that is pivotally joined to the base 32 at a hinge 38. A typical case 30 of this nature may contain a face powder, eye shadow or similar cosmetic product. The case 30 may be opened by pivoting the cover 36 away from the base 32 to expose the cosmetic contents the base, and closed in the same manner. Usually such cases include a latching mechanism, such as a resilient extension 40 of the cover and a cooperating protuberance (not shown) on the base, to retain the case in the closed position until sufficient force is applied to open it.

The cosmetic case 30 with which the embodiment of the display package shown in FIGS. 3 through 5 is particularly designed to cooperate is rectangular or square in overall shape, although the invention is envisioned to be used with openable cases of other shapes. One problem which is particularly inherent with packaging square cosmetic cases, which problem is overcome by the present invention's design, is how to secure the cosmetic case 30 to the support backing 4, allowing the cover 36 of the case to open and close without the blister interfering the operation of the case's hinge 38. The hinge 38 includes a pair of cylindrical projections extending from opposite sides of the base and a corresponding pair of openings within opposing flange portions 34 of the cover 36. The top side of the base 32 includes a bevelled edge 42 which will not interfere with the operation of the cover 36.

As shown in FIGS. 3 through 5, the case 30 is retained in the main blister portion 12 of the pre-formed blister 6, with the top wall 14 of the blister covering most, if not all, of the cosmetic product contained in the base 32. This, of course, protects the cosmetic product from being touched or used prior to purchase. The height of the side walls 16 of the first pre-formed blister, or stated another way, the height that the main blister portion 12 is raised from the display surface 10 of the backing, is at least equal to the height of the base 32 of cosmetic case 30 so that the case closely fits in the pocket 20 defined by the first blister 6.

The display package 2 is designed so that the hinge portion 38 of the cosmetic case extends from the pocket 20 defined by blister through the blister's open side 18. This allows the cover 36 of the case to pivot freely on the base 32 without the blister 6 interfering with the case hinge 38. The cover 36 may be opened, so that the contents of the cosmetic case 30 may be viewed through the blister 6, and closed such that the top wall 14 is sandwiched between the base 32 and the cover 36. Because of the relative thinness of the blister 6, the latching mechanism of the case is still operational with the case contained in the blister pocket 20, as the resilient extension 40 of the cover still properly engages the protuberance on the base even with the blister 6 interposed between them. When the case 30 is closed and latched, it will not slide in the blister pocket 20, thus further securing the case in the blister 6.

The tongue 8 helps prevent the case 30 from being removed from the first blister 6 through the open side 18 of the pocket when the case is unlatched and opened. As mentioned previously, the tongue 8 extends over the open side 18 of the blister 6. A portion of the tongue adjoining the main blister portion 12 runs substantially parallel to the display surface 10. The length of the tongue 8 is sufficient to allow it to be passed between the base and cover of the case 30 and to be secured to the display surface 10. The blister material is sufficiently thin so that it does not interfere with the opening and closing of the cover 36. The tongue 8 prevents the cosmetic case, when unlatched, from sliding out of the pocket 20 through the open side 18 thereof. This feature provides the display package of the present invention with a measure of tamper resistance, to deter a purchaser from removing the cosmetic article from the package prior to purchasing the article.

In its preferred form, the tongue 8 extends over the bevelled edge 42 of the base 32, down the top side of the base, and forms substantially a right angle where it adjoins the display surface 10. It accordingly does not interfere with the operation of the case hinge 38, or engage a portion of the cover 36 to prevent the case from opening. As shown in phantom in FIG. 4, the cover 36 of the case can be opened to be at least perpendicular to the base 32 to fully expose the cosmetic contents of the base without the tongue 8 interfering with the movement of the cover 36.

The pre-formed blister 6 may be formed from a variety of materials, such as a vinyl resin or other thermoplastic material. A five gauge vinyl resin blister material is conventionally used, which has a thickness of between about 3 and 4 mils. Of course, the blister material may be heavier, on the order of 5–7 mils or more in thickness. The thinner material is preferred so that the tongue 8 easily passes through the clearance defined between the cover 36 and base 32.

The pre-formed blister 6, or at least the main blister portion 12 thereof, is preferably transparent so that the cosmetic product can be viewed by the through the blister prior to purchasing the cosmetic article. The pre-formed blisters 6 and tongue 8 may be separate components mounted on the support backing 4, or may be integrally formed together, as shown by FIGS. 1–5. In the former case, the tongue would be adhered to the blister at one end and the display surface 10 at the other end.

The display package 2 and cosmetic case 30 are preferably assembled together. The base 32 of the cosmetic case, while the case is opened, is fitted into the pre-shaped pocket 20 of the first blister 6 that it at least partially conforms to the base's shape, with the cosmetic case 30 being oriented with its hinge 38 situated on the open side 18 of the blister 6 and the tongue 8 extending through the clearance between the cover and base. The case 30 is then closed such that the main blister portion 12, and in particular its top wall 14, is interposed between the base 32 and cover 36 of the cosmetic case and secured in place relative to the case so that the blister 6 will not shift.

The blister 6 and case 30 are then mounted on the display surface 10 of the support backing 4, with the edge flange 22 of the blister and the end of the tongue being heat sealed or adhesively joined to the backing.

The display package of the present invention is thus a tamper resistant package for a cosmetic article, and in particular a cosmetic case, which lets the purchaser open the case to examine its contents without having to remove the case from the package. The contents of the cosmetic article may be viewed through the blister so that the purchaser can determine, prior to purchasing the article, whether the cosmetic product is suitable for her use. The use of the pre-formed blister, and projecting tongue is a simple yet effective way of packaging the cosmetic case and allowing the case to be opened and closed without removing the case from the package.

Figure 6:
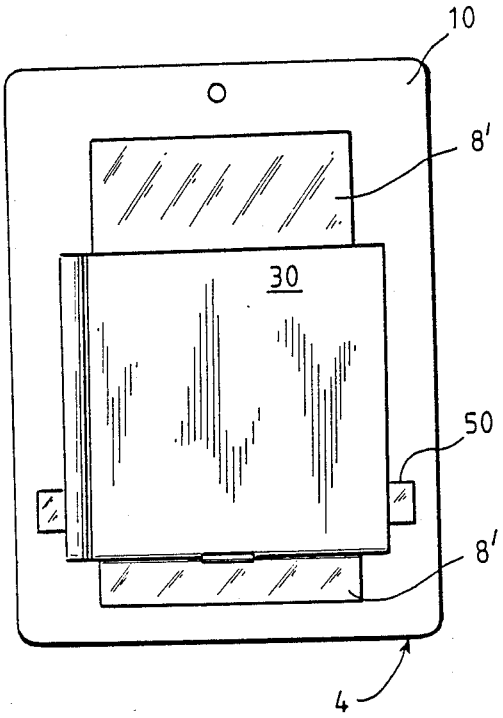
FIG. 6 is a first elevation view of a display package constructed in accordance with another form of the present invention.

Referring now to FIG. 6, an alternative embodiment of the invention is disclosed which obviates the need for side walls 16 joined to the top wall of the main blister portion. In accordance with this embodiment of the invention, a single, flexible, transparent strip 8' of uniform width is employed to secure the case 30 to the support backing 4. The strip includes first and second end portions which are secured to the display surface 10 and an intermediate portion covers the base 32 of the case and passes through the clearance between the base and cover. The width of the strip 8' is substantially equal to the distance between the opposing flange portions 34 of the cover to limit the lateral movability of the case. A second strip 50 extends laterally across the first strip near the bottom of the case. By securing the ends of the second strip to the lateral edge portions of the display surface 10, the case is locked in position.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A display package for a cosmetic article, which comprises:

a support backing having a display surface;

a pre-formed blister mounted on the display surface of the support backing, the pre-formed blister having a main blister portion including a top wall which is raised from the display surface, an edge flange joined to the main blister portion and secured to the display surface, and side walls connecting said top wall with said edge flange, the main blister portion having an open side and defining a pocket for receiving a cosmetic article therein and for securing the article to the support backing; and a flexible tongue joined to and extending from said top wall of said main blister portion and extending over said open side of said main blister portion, said flexible tongue being of sufficient length to be contacted with said display surface.

2. A display package as defined by claim 1, wherein the main blister portion of the pre-formed blister is transparent.

3. A display package as defined by claim 1, wherein the support backing is formed from a substantially stiff material to resist bending thereof.

4. A display package as defined by claim 1, wherein said tongue is integrally formed with said top wall of said main blister portion.

5. A display package as defined by claim 1, wherein at least a portion of said tongue extends parallel to and above the display surface of the support backing.

6. A display package as defined by claim 1, wherein said pre-formed blister is formed from a thermoplastic material.

7. A display package assembly comprising:

a support backing having a display surface;

a pre-formed blister mounted on the display surface of the support backing, the pre-formed blister having a main blister portion which is raised from said support backing and an edge flange joined to said main blister portion having an open side and defining a pocket for receiving an article and for securing the article to said support backing;

a case including a base, a cover pivotally joined to said base, and a clearance defined between said base and said cover, at least a portion of said base being positioned within said pocket, said cover being positioned outside said pocket; and a flexible tongue including a first end joined to said main blister portion and a second end joined to said display surface, said flexible tongue extending over said open side of said main blister portion and through said clearance between said base and said cover, thereby retaining said base of said case within said pocket.

8. An assembly as defined in claim 7 wherein said tongue is integrally formed with said main blister portion.

9. An assembly as defined in claim 7 wherein said pre-formed blister is transparent.

10. An assembly as defined in claim 7 wherein at least a portion of said tongue extends parallel to and above said display surface.

11. A display package assembly comprising:

a support backing having a display surface;

a case mounted to said display surface, said case including a base, a cover, a hinge assembly connecting said cover to said base, and an end clearance defined by said hinge assembly between said base and said cover; and a flexible strip including first and second end portions and an intermediate portion connecting said first and second end portions, said first and second end portions being joined to said support backing, said intermediate portion extending between said base and said cover and passing through said clearance defined by said hinge assembly, thereby retaining said case upon said support backing.

12. An assembly as defined in claim 11 wherein said first and second end portions of said strip are secured, respectively, to said display surface on opposite sides of said case.

13. An assembly as defined in claim 12 wherein said strip is transparent.

14. An assembly as defined in claim 12 wherein said cover is pivotally joined to said base at an end thereof adjoining said end clearance.

15. An assembly as defined in claim 12 wherein said strip has a substantially uniform width.

16. A display package as defined in claim 1 wherein said main blister portion has a substantially rectangular configuration.

17. A display package assembly as defined in claim 7 wherein said main blister portion and said case each have a substantially rectangular configuration.

18. A display package assembly as defined in claim 11 wherein said case has a substantially rectangular configuration.

19. A display package assembly as defined in claim 7 including a hinge assembly connecting said base and said cover, said tongue extending through said hinge assembly.

* * * * *